US006673758B2

(12) United States Patent
Messina

(10) Patent No.: US 6,673,758 B2
(45) Date of Patent: Jan. 6, 2004

(54) DECARBONIZATION/CONDITIONING FORMULATION FOR INTERNAL COMBUSTION ENGINES AND METHOD THEREFORE

(76) Inventor: Frank A. Messina, 3548 W. Louisiana State Dr., Kenner, LA (US) 70065

( * ) Notice: Subject to any disclaimer, the term of this patent is extended or adjusted under 35 U.S.C. 154(b) by 253 days.

(21) Appl. No.: 09/929,686

(22) Filed: Aug. 14, 2001

(65) Prior Publication Data

US 2003/0040448 A1 Feb. 27, 2003

(51) Int. Cl.[7] ..... C11D 9/04

(52) U.S. Cl. ..... 510/183; 510/184; 510/185; 510/186; 510/505; 510/506; 134/20; 134/39; 123/1 A; 123/198 A

(58) Field of Search ..... 510/183, 184, 510/185, 186, 505, 506; 134/20, 39; 123/1 A, 198 A

(56) References Cited

U.S. PATENT DOCUMENTS

| | | | |
|---|---|---|---|
| 1,160,682 | A | 11/1915 | Ahern |
| 1,455,574 | A | 5/1923 | Eastman |
| 1,483,559 | A | 2/1924 | Sullivan |
| 1,895,413 | A | 1/1933 | Geanas |
| 2,251,988 | A | 8/1941 | Curran |
| 2,259,872 | A | 10/1941 | Baldeschwier |
| 2,281,695 | A | 5/1942 | James et al. |
| 2,641,267 | A | 6/1953 | Faulkner |
| 3,779,213 | A | 12/1973 | Knudsen |
| 5,271,361 | A | 12/1993 | Flynn |
| 5,858,942 | A | 1/1999 | Adams et al. |
| 5,970,994 | A | 10/1999 | Sasaki et al. |

OTHER PUBLICATIONS

MSDS MSN9150010526762, Cooper Industries Wagner Brake Division—Premium Plus Brake Fluid, H–121.

*Primary Examiner*—Necholus Ogden
(74) *Attorney, Agent, or Firm*—Joseph J. Regard Ltd.

(57) ABSTRACT

A decarbonization formulation for removing carbon deposits and the like, and method of application therefore. The preferred embodiment of the present invention teaches a method for removing carbon deposits from an internal combustion engine and composition therefore wherein there is utilized a solution comprising water and glycol ether based brake fluid in about a 50/50 ratio. The preferred brake fluid utilized in the present invention is H-121 Premium Plus Brake Fluid by Cooper Industries, Wagner Brake Division of St. Louis, Mo. The solution is chilled to about 40–50 degrees and about one pint is added in liquid form to the air intake with the engine running at about 2000 rpms over a period of about one minute. The concentration, temperature of the fluid, and rate of application can vary depending upon the size and type of engine. It is theorized that the brake fluid, diluted with water, forms a decarbonizing agent, and the chilled fluid further creates a temperature differential which facilitates removal of scale carbonization on the metal components contacted by the solution.

5 Claims, No Drawings

DECARBONIZATION/CONDITIONING FORMULATION FOR INTERNAL COMBUSTION ENGINES AND METHOD THEREFORE

TECHNICAL FIELD OF THE INVENTION

The present invention relates to systems for the conditioning of internal combustion engines or the like, and in particular to a decarbonization formulation for removing carbon deposits and method of application therefore.

The preferred embodiment of the present invention teaches a method for removing carbon deposits from an internal combustion engine and composition therefore wherein there is utilized a solution comprising water and glycol ether based brake fluid in about a 50/50 ratio. The preferred brake fluid utilized in the present invention is H-121 Premium Plus Brake Fluid by Cooper Industries, Wagner Brake Division of St Louis, Mo., although other glycol ether-based brake fluids may likewise be utilized, albeit with different results.

The solution is chilled to about 40–50 degrees and about one pint is added in liquid form to the air intake with the engine running at about 2000 rpms over a period of about one minute. The concentration, temperature of the fluid, and rate of application can vary depending upon the size and type of engine.

It is theorized that the brake fluid, diluted with water, forms a decarbonizing agent, and the chilled fluid further creates a temperature differential which facilitates removal of scale carbonization on the metal components contacted by the solution.

BACKGROUND OF THE INVENTION

The general concept of introducing a decarbonization or conditioning fluid into the combustion chamber of an internal combustion engine via the air intake is not entirely new, having been contemplated in various forms since about the time of the internal combustion engine. This is because hydrocarbon based fluids have been the preferred fuel for internal combustion engines since their inception. Carbonization of the internal engine components associated with the combustion cycle is a byproduct of the hydrocarbon combustion.

Accordingly, various formulations and techniques have been utilized in an attempt to renew engines which have lost power due to carbonization, which reduces efficiency. A list of patents which may have some pertinence to the present invention include:

| Patent Number | Inventor | Date of Issue |
|---|---|---|
| 1160682 | Ahern | Nov. 16, 1915 |
| 1455574 | Eastman | May 15, 1923 |
| 1483559 | Sullivan | Feb. 12, 1924 |
| 1924722 | Lovell | Aug. 29, 1933 |
| 2251988 | Curran | Aug. 12, 1941 |
| 2259872 | Baldeschwieler | Oct. 21, 1941 |
| 2641267 | Faulkner | Jun. 09, 1953 |
| 3779213 | Knudsen | Dec. 18, 1973 |
| 5271361 | Flynn | Dec. 21, 1993 |

U.S. Pat. No. 5,271,361 issued 1993 teaches a system for conditioning and removing carbon deposits and related residue from an internal combustion engine via the application a standard "carbon removing agent, such as glycol ether." (Column 4, lines 27–31), thereby indicating that glycol ether (brake fluid) has been utilized as a decarbonization agent for internal combustion engines in prior patents, albeit not in the formulation contemplated in the preferred embodiment of the present invention.

U.S. Pat. No. 2,251,988 issued 1938 teaches a "Method of Purging the Internal Parts of Internal Combustion Engines" wherein a cool liquid is introduced to a warmed engine, and wherein the temperature differential aids in the purging or cleansing of the engine. The composition is introduced by way of the air intake or intake manifold of the carburetor. See also U.S. Pat. No. 1,160,682, which teaches a "Method of Decarbonizing Internal Combustion Engines" wherein a "very cold" liquid is introduced to the engine (described as a "non-combustible refrigerating liquid" via the air-intake to "suddenly contract and shatter" the carbon deposits.

An example of a mixture which can be utilized is described as 80% water and 20% ammonia, although it is indicated that other solutions may be likewise used. Thus, the concept of a chilled liquid including water, introduced to the air intake to "shatter" the carbon from the engine parts has been contemplated in prior patents. U.S. Pat. No. 3,779,213 teaches the introduction of nothing more than "normal" water for such an operation.

Thus, the prior art has contemplated various diverse fluid formulations and techniques for conditioning and/or decarbonization of internal combustion engines, although none are believed to be utilized on a widespread basis; perhaps such lack of use is a testament to less than satisfactory performance, or difficulty in implementation.

GENERAL SUMMARY DISCUSSION OF THE INVENTION

In contrast to the above cited prior art, the present invention provides a decarbonization formulation and method of use therefore which quickly and effectively reduces carbon deposits, hydrocarbon residues, dirt, tars, and other contaminants in a variety of internal combustion engines in a manner which is easy to implement, reliable and safe in operation, and which results in a noticeable increase in efficiency in engines with significant carbonization.

It has been found that Cooper Industries, Wagner Brake Division of St. Louis, Mo. produces a brake fluid under the brand H-121 PREMIUM PLUS, which brake fluid, when mixed with about equal parts water and cooled to a temperature of about 35–50 degrees Fahrenheit, then introduced into the air intake (for example, at a rate of about one quart over a period of 3–4 minutes for a 350 Cubic Inch V-8 at about 1500–3000 rpm at operating temperature (about 185 degrees Fahrenheit)) provides a combined chemical, heat catalytic reaction where the cooled fluid fractures and dislodges carbon adhered to the metal engine parts, this "chill shock" as referred to by the applicant further supplemented by the glycol ether-based formulation of the H-121 PREMIUM PLUS brand brake fluid combined with water.

The fluid may be dispensed into the air intake of the engine, be it via carburetor or air intake in a fuel injection system. During application of the formulation of the engine, the engine should be heated to operational temperature so as to heat the carbon deposits and metallic substrates said deposits are mounted upon to facilitate the "chill shock" of the carbon deposits. The engine should be operated at a relatively high rpm, which can vary depending upon the type of engine; for example, a V-8 gasoline engine may be operated at up to 2800 rpm or even slightly higher, depending upon the type, while the formulation is carefully poured into the intake so that a quart is poured in within 3–4 minutes, while carefully monitoring the RPM's of the engine and lessening or ceasing application of the formulation when the engine RPM's are significantly reduced, for example, dipping below 1800 RPM's.

Upon application of the predetermined amount of formulation, the engine should continue to be run, and the RPM's may be varied between 2000–2800, for example, to facilitate passing of the fluid through the exhaust system, where it is exhausted in the form of smoke, water vapor, and carbon particulates.

The present invention thereby cleans the internal working surfaces of the engine, including the carburetor (when present), combustion chamber, piston surface, piston rings, valves, exhaust manifold, and exhaust passages.

It is therefore and object of the present invention to provide a system for removing carbon deposits from an internal combustion engine which is easy to implement, cost effective, and reliable and safe in operation.

It is another object of the present invention to provide a system for decarbonizing which will not harm the engine or the environment.

It is another object of the present invention to provide a system for decarbonizing which may be utilized with a wide variety of internal combustion engines, gasoline or diesel.

It is another object of the present invention to provide a method of decarbonizing an internal combustion engine which requires no special tools or training.

Lastly, it is an object of the present invention to provide a system for decarbonizing an internal combustion engine which may be utilized at any stage of an engine's life, offering beneficial treatment for even old engines which have never been decarbonized.

DETAILED DISCUSSION OF THE INVENTION

In the preferred embodiment of the present invention, the a formulation of between 50–60% water chilled to 35–50 degrees is combined with brake fluid, preferably H-121 PREMIUM PLUS brand from Cooper Industries, Wagner Brake Division of St. Louis, Mo., so as to provide a formulation in the amount of about one quart for one 350 V8 engine.

In the present example, the engine is run until reaching operating temperature of about 160–190 degrees Fahrenheit and at an throttled idle speed of 1500–3000 RPM, the higher RPM within the operating criteria for the engine the better, while pouring or splashing the quart into the air intake of the engine (bypassing the air filter) so that the contents are dispensed within three to four minutes, while monitoring the RPM's and reducing or temporarily halting pouring of the formulation when the engine RPM dips below 1500 RPM or otherwise is substantially reduced or threatens to stall.

After dispensing the formulation, the engine continues to be run at an accelerated revolutions per minute (RPM) for one to several minutes to allow the engine to pass the formulation through the system. Water vapor, and carbon particles are passed through the exhaust, with the brake fluid partially combusting and the remainder exiting the exhaust as smoke.

The present system should be implemented every six months to a year with a gasoline engine under normal use, in order to maintain the engine relatively free of carbon.

Unlike hydrocarbons such as kerosene, brake fluid mixes with the water and does not stratify, while the glycol ether and other compounds in the H-121 brand formulation are found to provide decarbonization superior to other brands. The MSDS for the H-121 formulation provides a breakdown of the formulation, which MSDS document is incorporated herein by reference, MSN number 9150010526762. The formulation is broken down as follows:

| Ingredient | Percentage Range |
|---|---|
| Diethylene Glycol Monobutyl Ether | 10–20% |
| Polyoxypropylene Glycol | 10–12% |
| Ethanol, 2-(2-(2-Butoxyethoxy) Ethoxy)-/Triethylene Glycol | 30–40% |
| Di-/Tetraethylene Glycol Mixture | 20–25% |
| Diethylene Glycol, mixed Alkyl Ether (C–C6) | 5–10% |
| Triethylene Glycol, Mixed Alkyl Ethers (C1–C6) | 5–10% |

The above formulation is indicated as having a boiling point of 481 F. a specific gravity of 1.04, soluble in water, ph of 9.9, and flash point of greater than 200 F. The smoke created during the engine conditioning procedure should be avoided. Moderate inhalation may cause irritation, dizziness, headache. A NIOSH respirator may be utilized if high vapor or mist concentration s are expected.

As indicated, the present system may be utilized in small gas engines; for example, in a four cylinder engine, only one or possibly two pints is required. A similar procedure of running the engine to operating temperature, idling the engine to a high operating RPM, splashing the chilled formulation into the air intake bypassing the air filter so that the amount is consumed over 3–4 minute period while monitoring the RPM's and slowing dispensing when the RPM's substantially decrease or the engine threatens to cease. In small engines (i.e., less than 8 cylinder) it may take longer than 3–4 minutes to dispense the formulation; in these cases, the formulation should be dispensed into the air intake at a rate which does not significantly impair engine operation; i.e., when RPM's drop substantially (for example, greater than 10–15%) or when the engine begins to sputter or threaten to quit, dispensing of the formulation should be slowed or stopped until the engine has recovered.

The optimal amount of formulation for dispensing to each type of engine may vary, but as a general guide, the amount of formulation it an engine to consume at full RPM with low to moderate reduction of the RPM during consumption should be all that is necessary to treat the engine. Accordingly, in larger engines, including diesel engines, more than one quart may be implemented.

In summary, the method of the present invention may comprise the steps of:

I. preparing a formulation comprising 40–60% water and 40–60% brake fluid;

ii. cooling said formulation to a temperature of between 35–50 degrees Fahrenheit;

iii. operating the engine until it reaches operating temperature;

iv. throttling the engine to effect rapid operation of the engine; while v. introducing the formulation to the air intake of the engine so as not to stall the engine;

vi. allowing the chilled formulation to dissolve and remove contaminants from the engine, providing dislodged contaminants;

vii. allowing the heated engine to evaporate said water, forming water vapor, while allowing said heated engine to engage said brake fluid, forming smoke;

viii. allowing said engine to urge said dislodged contaminants, water vapor, and smoke through the exhaust system.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. The method of cleaning the internal parts of an internal combustion engine comprising the steps of:

I. preparing a formulation comprising 40–60% water and 40–60% brake fluid;

ii. cooling said formulation to a temperature of between 35–50 degrees Fahrenheit;

iii. operating the engine until it reaches operating temperature;

iv. throttling the engine to effect rapid operation of the engine; while v. introducing the formulation to the air intake of the engine so as not to stall the engine;

vi. allowing the chilled formulation to dissolve and remove contaminants from the engine, providing dislodged contaminants;

vii. allowing the heated engine to evaporate said water, forming water vapor, while allowing said heated engine to engage said brake fluid, forming smoke;

viii. allowing said engine to purge said dislodged contaminants, water vapor, and smoke through the exhaust system.

2. The method of claim 1, wherein in step "I" said brake fluid comprises a mixture of diethylene glycol monobutyl ether, polyoxypropylene glycol, ethanol, 2-(2-(2-butoxyenthoxy), triethylene glycol, di-/tetraethylene glycol, C1–C6 diethylene glycol, and C1–C6 triethylene glycol.

3. The method of claim 2, wherein in step "iv" said engine is throttled to between 1500–3000 revolutions per minute.

4. The method of claim 3, wherein said engine is a 350 V8 automobile engine, and wherein in step "v" said one quart of said formulation is introduced into said air intake over a period of between three to four minutes.

5. The method of claim 2, wherein there is provided the additional step ix. of continuing to operate the engine until all dislodged contaminants, water vapor, and smoke has passed though the exhaust system.

* * * * *